United States Patent [19]

McMillan

[11] 3,965,777

[45] June 29, 1976

[54] BROKEN NEEDLE REMOVAL TOOL FOR KNITTING MACHINES

[76] Inventor: Charles G. McMillan, Rte. 9, Box 218, Mount Airy, N.C. 27030

[22] Filed: Sept. 29, 1975

[21] Appl. No.: 617,701

[52] U.S. Cl. ..... 81/5.1 R; 81/309

[51] Int. Cl.[2] ..... B25B 7/00

[58] Field of Search ..... 81/5.1 R, 3 CP, 303, 81/308, 309; 29/268; 7/3 R, 4, 5, 5.1 R

[56] References Cited

UNITED STATES PATENTS

| | | | |
|---|---|---|---|
| 2,578,506 | 12/1951 | Carnes, Jr. | 81/5.1 R |
| 3,825,990 | 7/1974 | Shields | 81/5.1 R |
| 3,906,561 | 9/1975 | Bawa | 7/5.4 |

*Primary Examiner*—Al Lawrence Smith
*Assistant Examiner*—Roscoe V. Parker, Jr.
*Attorney, Agent, or Firm*—B. B. Olive

[57] ABSTRACT

A plier-type tool having opposed jaw members and elongated handle portions is provided with a retractable wedge member for removing knitting machine needles which have broken butt portions. The wedge member is formed at the outwardly protruding end of a spring-loaded shaft member which is slidably mounted on the plier tool. The wedge member tip portion forces the needle butt from within the needle slot and allows the plier tool to move inward to grasp the broken butt between the opposed jaws for withdrawal of the needle completely from the needle slot.

7 Claims, 10 Drawing Figures

BROKEN NEEDLE REMOVAL TOOL FOR KNITTING MACHINES

BACKGROUND OF THE INVENTION

1. Field of the Invention

The invention relates to hand tools of the plier type and particularly to a plier-type tool for removal of broken knitting machine needles from their needle slots.

2. Description of the Prior Art

Heretofore, it has been the practice in the knitting industry to remove broken needles with another needle, a wedge device, or another thin object which, when placed behind the broken needle, forced the needle outward so that the operator could employ a conventional pair of pliers to remove the needle. Such an operation required two hand operations and two separate tools. This method of needle extraction has proved to be time consuming when needles are constantly breaking and when the operator is watching several machines.

U.S. Pat. No. 2,578,506 to Julian E. Carnes, Jr., describes the only tool known to applicant specifically designed for removal of broken knitting needles. This patented tool comprises a conventional pair of pliers having a curved, outwardly protruding projection on one jaw member for engaging the broken needle and forcing its butt portion between the plier jaws for removal. However, the patented tool has several drawbacks. First, the device can be used ony when a substantial part of the butt portion remains after needle breakage since the tool is designed to grip only the butt. Second, removal of the needle is made particularly difficult because the tool grips only the thin edge portion of the butt instead of the flat side portion. Third, the butt portion must be located precisely within a pair of grooves in the jaws before removal. A fourth drawback of the patented tool is that it is not well adapted to use on different knitting machines having a wide range of needle and slot sizes.

A review of the prior art indicates that there is an acute need for a simple and reliable tool useful for removing broken knitting needles from the various types of knitting machines presently in use.

SUMMARY OF THE INVENTION

The invention is directed to a tool which aids in the removal of broken knitting needles. The tool, according to the present invention, employs a plier-like device having opposed jaw members and a pair of elongated handles for grasping the tool. Such a device is illustrated in the present invention as being similar to a long reach duck-bill plier. In the preferred form, an integral boss is secured to one of the opposed jaw members for slidably receiving a shaft. The outwardly protruding end portion of the shaft has a wedge-shaped hook tip which is adapted to enter the needle slot behind the needle and force out the needle so that it can be grasped between the opposed jaws of the pliers. A coil spring positioned around the shaft serves to spring load the shaft so that the plier jaws can be brought forward to engage the needle for removal.

DESCRIPTION OF THE PREFERRED EMBODIMENT

Figure 1:
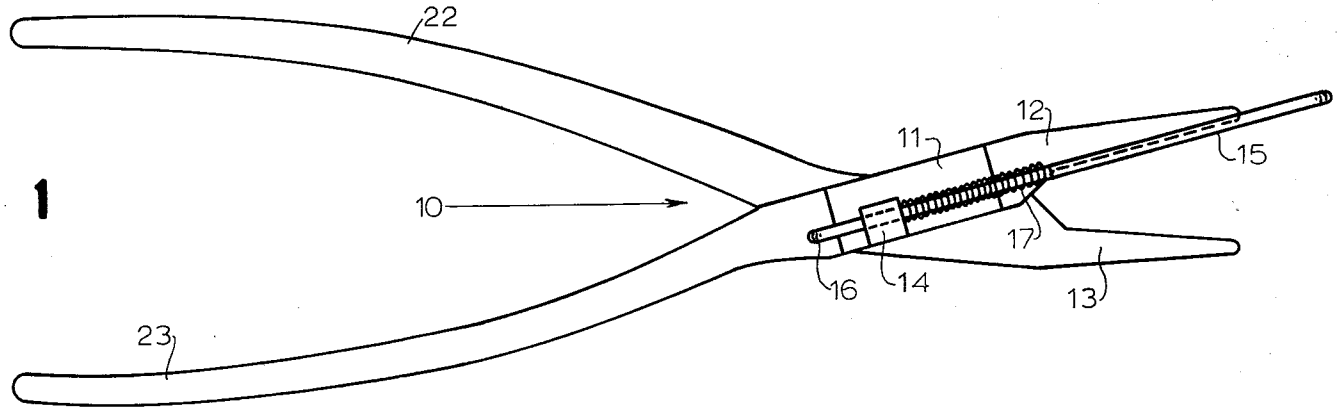
FIG. 1 is a bottom plan view of the needle extracting tool of the present invention.
Figure 2:
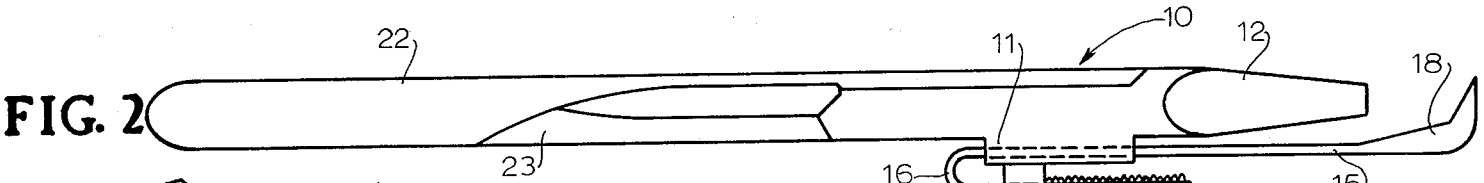
FIG. 2 is a side elevation view of the tool of FIG. 1.

FIGS. 1 through 6 illustrate the preferred embodiment of the needle extracting tool 10 of the present invention. Tool 10 is illustrated in the form of a long reach duck-bill plier having handle portions 22, 23 and jaw members 12 and 13 and having an integral boss 11. Boss 11 has the same width as the tool jaw 12 upon which it is formed and has a predetermined length which is shown being less than the length of jaw 12 (FIG. 1). A second boss 14 extends from boss 11 and is formed as an integral part thereof. Boss 11 slidably receives the elongated portion of a shaft 15. Shaft 15 is curved at 16 and passes back through boss 14 in a plane parallel to the elongated portion of shaft 15. A coil spring 17 is mounted on shaft 15 between the front wall of boss 14 and the inner free end of shaft 15. Spring 17 is attached to this free end of shaft 15 by any suitable means. The outwardly protruding end of shaft 15 is formed as a flattened wedge hook member 18. Shaft 15 can be forced back within boss 11 which in turn causes spring 17 to be compressed on shaft 15. Once pressure against wedge 18 is released, spring 17 forces shaft 15 back into its original position. The wedge hook member 18 of tool 10 is of a width that will allow it to enter the needle slots of a conventional knitting machine.

Figure 3:
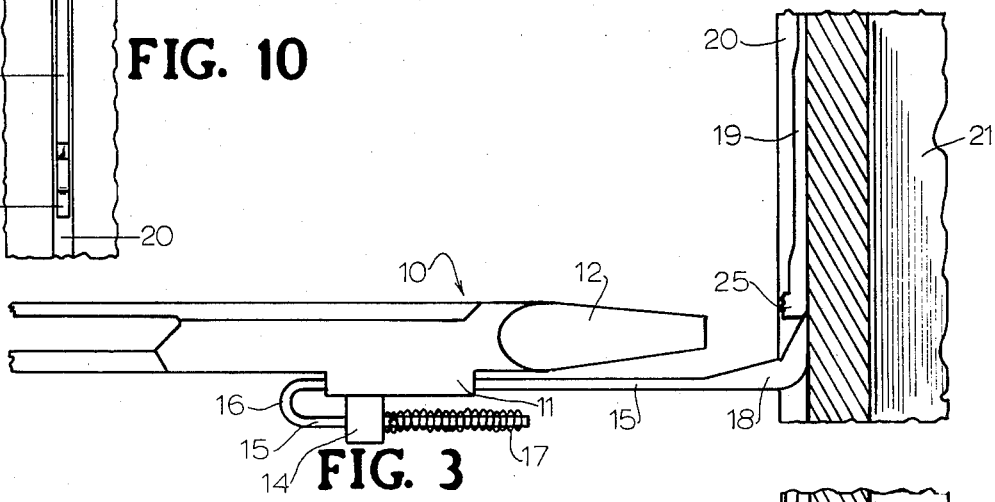
FIG. 3 is a fragmentary elevation view partially in section of the hook tip portion of the needle extracting tool in the needle slot of the needle cylinder prior to extraction of the needle with the broken butt.

Referring to FIGS. 3 through 10, a knitting machine needle cylinder or flat bed 21 has a plurality of evenly-spaced needle slots 20 and needles 19. The butt portion of a needle may become broken, as at 25, when the needle engages an operating cam at the wrong time or otherwise strikes a flat object. As illustrated in FIG. 3, no portion of the broken needle 19 is extending beyond the outside wall of cylinder or bed 21 in a typical situation.

Figure 4:
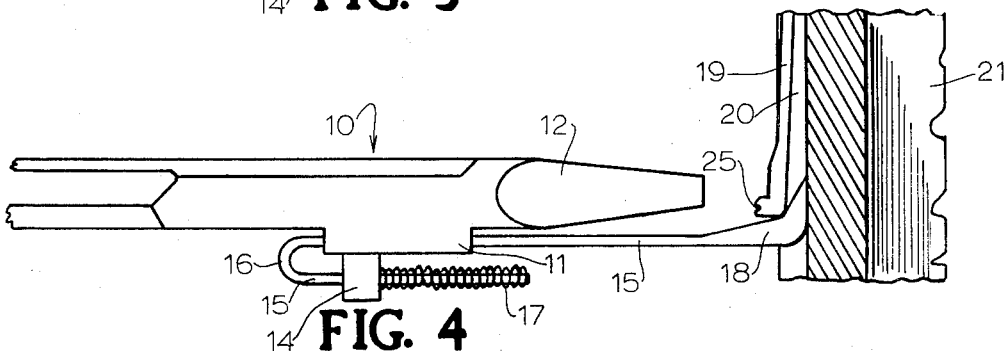
FIG. 4 is a view similar to that of FIG. 3 with the hook tip portion having engaged and forced the needle outward from within the cylinder slot.
Figure 5:
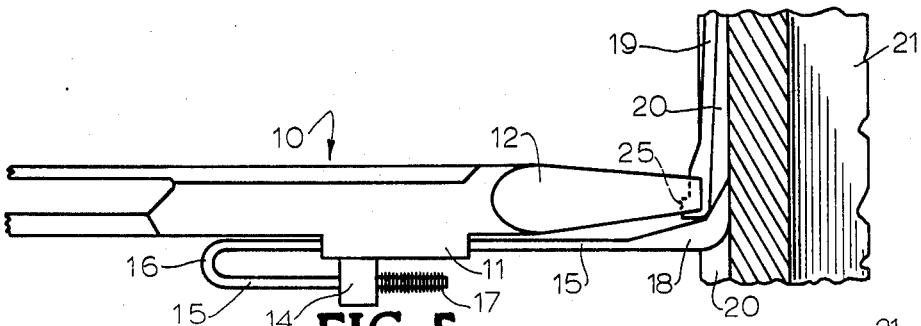
FIG. 5 is a view similar to that of FIGS. 3 and 4 with the needle extracting tool moved forward and the jaws of the tool gripping the broken butt portion of the needle.
Figure 6:
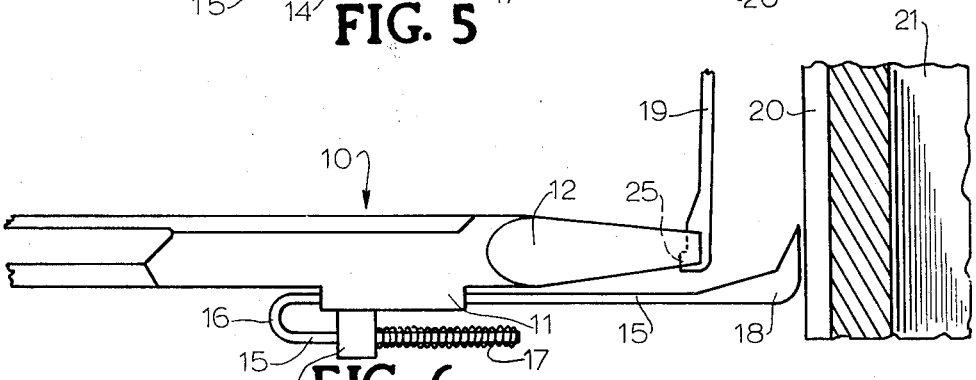
FIG. 6 is a view similar to that of FIGS. 3, 4 and 5 with the needle extracting tool having completely removed the broken needle from the needle cylinder slot.

In order to remove needle 19, the operator grips handles 22, 23 of tool 10 and aligns hook tip 18 with needle slot 20 in which broken needle 19 is residing. Wedge hook tip 18 is moved into slot 20 until it rests against the back wall of slot 20 and is immediately beneath broken needle 19 (FIG. 3). Next, tip 18 is slid upward against the back wall of slot 20 until needle 19 is forced outwardly by the wedging effect of tip 18 (FIG. 4). At this point, tool 10 is moved inwardly allowing shaft 15 to slide within boss 11 against the compression of spring 17. Jaw members 12, 13 are at this point open and receive needle 19 within the opposed jaws 12, 13. Handles 22, 23 are now moved together thereby causing jaws 12, 13 to close on the sides of needle 19 (FIG. 5). Once the needle 19 is securely held within jaws 12, 13, tool 10 is withdrawn which effects removal of needle 19 from slot 20 (FIG. 6). As tool 10 is withdrawn, shaft 15 and tip 18 move back to their original positions due to the force of spring 17 acting against boss 14. Needle 19 is then discarded and a new needle is inserted in slot 20.

Figure 8:
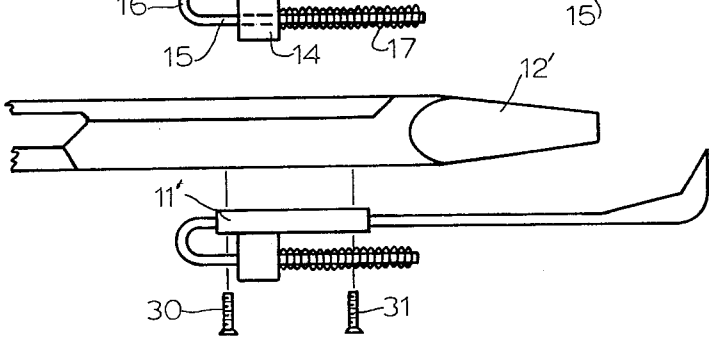
FIG. 8 is an exploded fragmentary side elevation view of the invention embodiment disclosed in FIG. 7.
Figure 7:
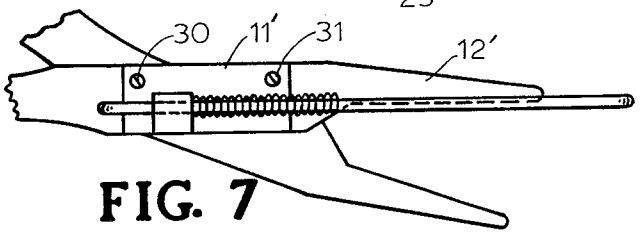
FIG. 7 is a fragmentary bottom view of a first alternative embodiment in which the needle extracting apparatus is constructed as a separate device and is illustrated as being capable of attachment to conventional plier tools by means of screws.

Referring now to FIGS. 7 and 8, an alternative embodiment of the invention is illustrated. In this embodiment, boss 11' is made as a separate piece from jaw 12'. A pair of set screws 30, 31 pass through boss 11' and into jaw member 12'. The screws 30, 31, when tightened, make boss 11' and jaw 12' an integral unit. The remainder of the tool is identical in construction to that of the preferred embodiment. The embodiment of FIGS. 7 and 8 is interchangeable with a wide variety of plier-type tools.

Figure 9:
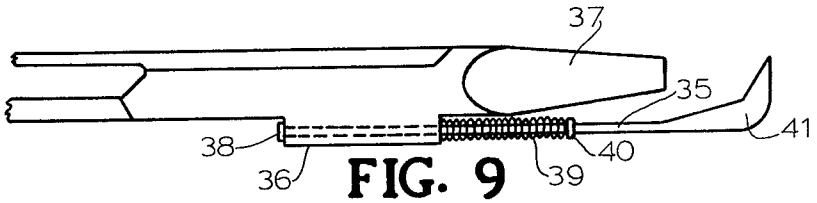
FIG. 9 is a second alternative embodiment which discloses a needle extractor attachment of a more simplified construction.
Figure 10:
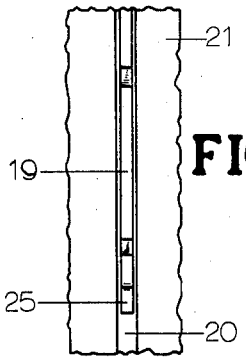
FIG. 10 is an enlarged view of one of the needles residing within a typical needle slot.

FIG. 9 illustrates a second alternative embodiment. In the tool of FIG. 9, a straight shaft 35 passes through a boss 36 and terminates at its outwardly protruding end in a hook tip 41 and at its inner end in a head portion 38. A coiled spring 39 is maintained on shaft 35 against boss 36 by a head 40. Shaft 35 is adapted to slide back and forth within boss 36 as spring 39 is compressed.

In summary, the present invention provides a tool for removal of broken knitting needles which can be manipulated with one hand, which requires only one tool to complete a removal operation, which cuts labor costs due to time savings, and which is versatile in that it is adaptable for use on any circular knitting machine or any flat bed knitting machine having a needle in a needle slot. This tool can also be used to pull cylinder jacks, pattern jacks, drum jacks, sliders, dial needles, or anything which resides in a groove or slot in a knitting machine and which has to be taken out when it is broken flush with the groove or slot.

While this tool is illustrated with a long reach duckbill plier, the extractor of the invention is readily adaptable to essentially any conventional plier-type tool having handle and opposed jaw members on which the invention extractor can be made integral or interchangeable therewith.

What is claimed is:

1. A tool for facilitating the removal of a slot-mounted machine element such as a knitting machine needle having a broken butt, comprising in combination:

a. a plier-type tool having on one end opposed pivotally-mounted jaw members having generally opposed flat, planar shaped surfaces for engaging and securely gripping said element and structurally interconnected with said jaws on the opposite end opposed elongated handle members and upon said handle members being forced together pivoting said jaw members together to cause said surfaces of said jaws to engage and securely grip said element; and b. an element extracting member mounted on said plier-type tool and operable independently of said jaws and comprising:

i. an elongated shaft slidably mounted below and on a selected one of said jaw members of said plier-type tool and being movable longitudinally in a selected plane substantially parallel to the plane of said jaw member on which such shaft is mounted as said jaw members pivot back and forth and having an outward end portion extending forwardly beyond said jaw members, said shaft being arranged so that it may be centered between said jaw members when said jaw members are in a closed position;

ii. a hook tip portion integral with said outward end portion of said elongated shaft and having a width less than the width of the slot in which the element is mounted; and iii. resilient return means for said extracting shaft arranged to normally hold said tip portion in a forward advanced position.

2. The tool of claim 1 wherein said elongated shaft is slidable within a boss made integral with said plier-type tool.

3. The tool of claim 1 wherein said hook tip portion is wedge-shaped.

4. The tool of claim 1 wherein said return means comprises a spring coiled about said elongated shaft.

5. The tool of claim 1 wherein said element extracting member is formed as a removable and interchangeable attachment for various plier-type tools.

6. The tool of claim 1 wherein said tool extracting member tip portion is specifically adapted to the removal of broken slot-mounted knitting machine needles.

7. A tool for facilitating the removal of a slot-mounted machine element such as a knitting machine needle having a broken butt, comprising in combination:

a. a plier-type device having forward pivotally-mounted opposed jaw and rearward handle members on connecting structure for operating said jaw members; and b. an element extracting member mounted on said plier-type device and operable independently of said jaw and handle members and comprising:

i. an elongated shaft slidably mounted on a portion of said plier-type device and with said shaft being movable longitudinally in a selected line and plane between the planes of said opposed jaw members and having outward end portion extending forwardly beyond said jaw members, said shaft being arranged so that it may be centered between said jaw members when said jaw members are in a closed position;

ii. a hook tip portion integral with said outward end portion of said elongated shaft and having a width less than the width of the slot in which said element is mounted; and iii. resilient return means for said extracting shaft arranged to normally hold said tip portion in a forward advanced position.

* * * * *